US006557786B1

(12) United States Patent
Frank

(10) Patent No.: US 6,557,786 B1
(45) Date of Patent: May 6, 2003

(54) METHOD FOR PRODUCING A HIGH PRESSURE FUEL ACCUMULATOR

(75) Inventor: Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,485

(22) PCT Filed: Sep. 28, 2000

(86) PCT No.: PCT/DE00/03387

§ 371 (c)(1),
(2), (4) Date: Oct. 1, 2001

(87) PCT Pub. No.: WO01/29404

PCT Pub. Date: Apr. 26, 2001

(30) Foreign Application Priority Data

Oct. 16, 1999 (DE) ..... 199 49 963

(51) Int. Cl.[7] ..... B05B 17/00; B05B 1/30; F02D 1/06; F02M 59/00

(52) U.S. Cl. ..... 239/533.2; 239/1; 239/5; 239/533.14

(58) Field of Search ..... 239/1, 5, 533.2, 239/533.14, 548; 123/456, 447, 468, 469, 470; 29/888.01, 888.124, 890.126

(56) References Cited

U.S. PATENT DOCUMENTS

| | | | | | |
|---|---|---|---|---|---|
| 3,655,530 | A | * | 4/1972 | Taylor | 204/26 |
| 3,767,555 | A | * | 10/1973 | Shaw | 204/224 M |
| 4,364,161 | A | * | 12/1982 | Stading | 29/407 |
| 4,508,480 | A | * | 4/1985 | Salm | 413/1 |
| 6,213,095 | B1 | * | 4/2001 | Asada et al. | 123/456 |
| 6,267,868 | B1 | * | 7/2001 | Wei et al. | 205/648 |

* cited by examiner

*Primary Examiner*—Michael Mar
*Assistant Examiner*—Davis Hwu
(74) *Attorney, Agent, or Firm*—Ronald E. Greigg

(57) ABSTRACT

The invention relates to a method for producing a high-pressure fuel reservoir for a common rail fuel injection system of an internal combustion engine, having a hollow base body (1) which is equipped with a plurality of connection openings (3).

In a simple method that can be performed inexpensively, a connection bore (4) is predrilled. The communication between the connection bore (4) and the interior (2) of the base body (1) is created with the aid of a further machining method.

4 Claims, 1 Drawing Sheet

METHOD FOR PRODUCING A HIGH PRESSURE FUEL ACCUMULATOR

CROSS-REFERENCE TO RELATED APPLICATIONS

This application is a 35 USC 371 application of PCT/DE 00/03387 filed on Sep. 28, 2000.

BACKGROUND OF THE INVENTION

1. Field of the Invention

The invention relates to a method for producing a high-pressure fuel reservoir for a common rail fuel injection system of an internal combustion engine, having a hollow base body which is equipped with a plurality of connection openings.

2. Description of the Prior Art

In common rail injection systems, a high-pressure pump, optionally with the aid of a prefeed pump, pumps the fuel that is to be injected out of a tank into the central high-pressure fuel reservoir, which is called a common rail. From the rail, fuel lines lead to the individual injectors, which are assigned one to each of the cylinders of the engine. The injectors are triggered individually by the engine electronics as a function of the engine operating parameters, in order to inject fuel into the engine combustion chamber.

One conventional common rail is described for instance in German Patent Disclosure DE 195 48 611. Conventional common rails are made from a forged blank, for instance. A longitudinal bore in the base body, the base body usually being elongated, acts as a fuel reservoir. The connection openings are created as a rule by bores. The region of intersection between the longitudinal bore and the connection bores, because of how it is produced, is sharp-edged and burred. Deburring and then cleaning the intersection region is complicated and expensive.

SUMMARY OF THE INVENTION

The object of the invention is to provide a method for producing a high-pressure fuel reservoir that is simple and economical. Furthermore, the high-pressure strength of the high-pressure fuel reservoir produced is to be improved.

In a method for producing a high-pressure fuel reservoir for a common rail fuel injection system of an internal combustion engine, having a hollow base body which is equipped with a plurality of connection openings, this object is attained in that a connection bore is predrilled, and that the communication between the connection bore and the interior of the base body is created with the aid of a further machining method. Within the context of the present invention, it has been found that the high-pressure strength of the high-pressure fuel reservoir, or common rail, is limited primarily by the intersections between the connection openings and the base body. By means of a machining step performed in addition to the drilling and deburring, the transitions between the connection openings and the base body can be blunted. As a result, the high-pressure strength of the common rail can be increased. In the present invention, the drilling is reduced to a predrilling operation. This markedly reduces drill wear. Moreover, the machining steps of drilling through and deburring are dispensed with.

A particular feature of the invention is characterized in that the further method involves an electrochemical machining method. With the electrochemical machining method, the communication between the predrilled connection bore and the interior of the base body is made on the one hand. On the other, a rounded transition between the predrilled connection bore and the interior of the base body is simultaneously created by the electrochemical machining method. This markedly increases the high-pressure strength of the high-pressure fuel reservoir according to the invention.

A further particular feature of the invention is characterized in that the connection bores are made at a tangent to the interior of the base body. For strength reasons, this arrangement of the connection bores has proved especially advantageous in practice. When the connection openings are being drilled through, however, drill breakage often occurs in this arrangement. This undesired tool wear is avoided by the two-staged creation of the connection bores that is provided for in the invention.

A further particular feature of the invention is characterized in that a plurality of connection bores are machined simultaneously with the aid of a multiple electrode. This reduces the machining time, which has a positive effect on production costs.

A further particular feature of the invention is characterized in that the intersection region between the connection bores and the base body interior is machined, in particular rounded, with the aid of the electrochemical machining. As a result, the intersection region can be optimized in a targeted way to improve the high-pressure strength of the high-pressure fuel reservoir of the invention still further.

BRIEF DESCRIPTION OF THE DRAWINGS

Further objects and advantages of the invention will become apparent from the ensuing description, taken in conjunction with the drawings, in which.

DESCRIPTION OF THE PREFERRED EMBODIMENTS

Figure 1:
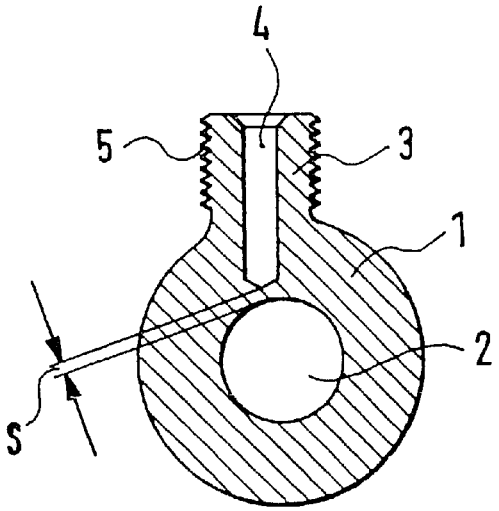
FIG. 1 is a cross section through a high-pressure fuel reservoir after the predrilling.

The high-pressure fuel reservoir, or common rail, shown in cross section in FIG. 1 includes a tubular base body 1. A longitudinal bore 2 extends axially in the tubular base body 1. The longitudinal bore 2 forms the storage volume of the common rail of the invention.

A plurality of connection stubs 3 are embodied on the tubular base body 1; only one of them can be seen in the cross section shown. A male thread 5 is embodied on the outer jacket face of the connection stub 3. The male thread 5 serves to fasten a high-pressure fuel line (not shown), which connects the common rail to one of the injectors of the internal combustion engine.

A connection bore 4 is predrilled in the connection stub 3. The connection bore 4 extends at a tangent, transversely to the longitudinal bore 2. The tip of the connection bore 4 is separated from the longitudinal bore 2 by a remaining wall thickness S.

Figure 2:
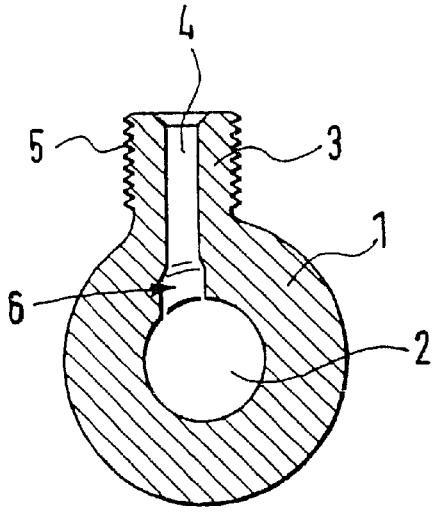
FIG. 2 is a view similar to FIG. 1 showing the high-pressure fuel reservoir of FIG. 1 after the further machining.

In the illustration of the common rail of the invention in FIG. 2, it can be seen that the remaining material in the transitional region 6 between the predrilled connection bore 4 and the longitudinal bore 2 has been removed. The removal of the material remaining after the predrilling is done, in the present invention, by electrochemical machining. In electrochemical machining, the metal material of the base body 1 is anodically broken up in the region 6 by the action of an electric current and an electrolyte solution. The current flow can be accomplished in a known manner by means of an external current source, or by forming a local element on the workpiece (internal voltage source).

Figure 3:
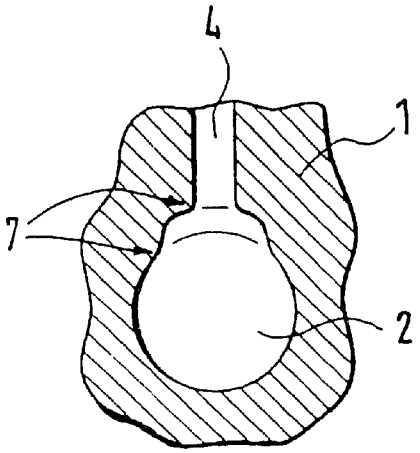
FIG. 3 is a detail of a further embodiment of the invention with rounded intersecting edges.

In the detail shown in FIG. 3 of a further embodiment of a common rail of the invention, the arrows at 7 indicate that the edges in the region where the connection bore 4 discharges into the longitudinal bore 2 are rounded. The rounding can be done by electrochemical machining, for instance.

Figure 4:
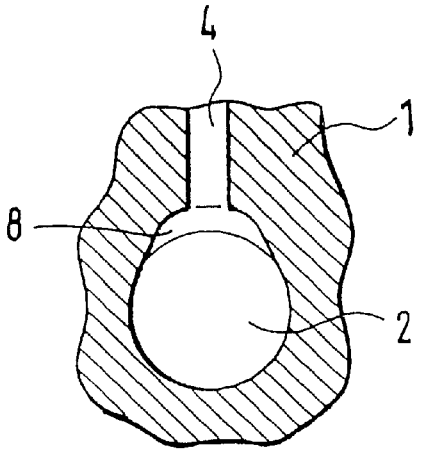
FIG. 4 is a detail similar to FIG. 3, with a special interior geometry.

In the further embodiment of the invention shown in fragmentary form in FIG. 4, still more material has been removed in the transitional region 8 between the connection bore and the longitudinal bore 2, in order to make the transition still more gentle. The removal of material is preferably done by electrochemical machining.

FIGS. 1 and 2 show the two stages in producing the intersection between the longitudinal bore 2 and the connection bore 4. In the first stage, the longitudinal bore 2 is drilled and the connection bore 4 is predrilled far enough that the remaining wall thickness S becomes minimal. In the second stage, by ECM, the communication is established between the longitudinal bore 2 and the connection bore 4. A multiple electrode can be employed in order to shorten the machining time.

With ECM, the geometry of the intersection can simultaneously be optimized in a targeted way, to achieve an optimal high-pressure strength of the common rail of the invention.

The foregoing relates to preferred exemplary embodiments of the invention, it being understood that other variants and embodiments thereof are possible within the spirit and scope of the invention, the latter being defined by the appended claims.

I claim:

1. A method for producing a high-pressure fuel reservoir for a common rail fuel injection system of an internal combustion engine, having a hollow base body (1) which is equipped with a plurality of connection openings (3), wherein a connection bore (4) is predrilled, and that the communication between the connection bore (4) and the interior (2) of the base body (1) is created with the aid of a further machining method, wherein the further method includes an electrochemical machining (ECM) method, wherein the intersection region (6, 7, 8) between the connection bores (4) and the base body interior (2) is rounded as part of the electrochemical machining.

2. The method of claim 1, wherein the connection bores (4) are made at a tangent to the hollow interior (2) of the base body (1).

3. The method of claim 2, wherein a plurality of connection bores (4) are machined simultaneously with the aid of a multiple electrode.

4. The method of claim 1, wherein a plurality of connection bores (4) are machined simultaneously with the aid of a multiple electrode.

* * * * *